US005237951A

United States Patent [19]

Almeida

[11] Patent Number: 5,237,951

[45] Date of Patent: Aug. 24, 1993

[54] MOUNTING SYSTEM FOR MARINE INSTRUMENTS

[76] Inventor: Geoffrey E. Almeida, 13 Mall St., Salem, Mass. 01970

[21] Appl. No.: 926,343

[22] Filed: Aug. 6, 1992

[51] Int. Cl.[5] ..... B63B 35/00

[52] U.S. Cl. ..... 114/270; 248/200

[58] Field of Search ..... 114/144 R, 144 E, 154–161, 114/222 R, 270; 248/200; 224/36

[56] References Cited

U.S. PATENT DOCUMENTS 4,338,875 7/1982 Lisowski ..... 114/221 R 4,392,446 7/1983 Vander Eyken et al. ..... 114/144 R

*Primary Examiner*—Jesûs D. Sotelo

*Attorney, Agent, or Firm*—Robert K. Tendler

[57] ABSTRACT

A hanging pad or pod is provided as an instrument mounting fixture for marine instruments, in which the pad or pod is suspended from the arch of a pedestal guard such that the instrument is upwardly inclined for easy viewing by presenting navigational data within the arch of the pedestal guard in the line of sight of the helmsman. The proximity of the pad or pod to the helmsman permits data entry within easy reach of the helmsman.

17 Claims, 7 Drawing Sheets

FIG. 6
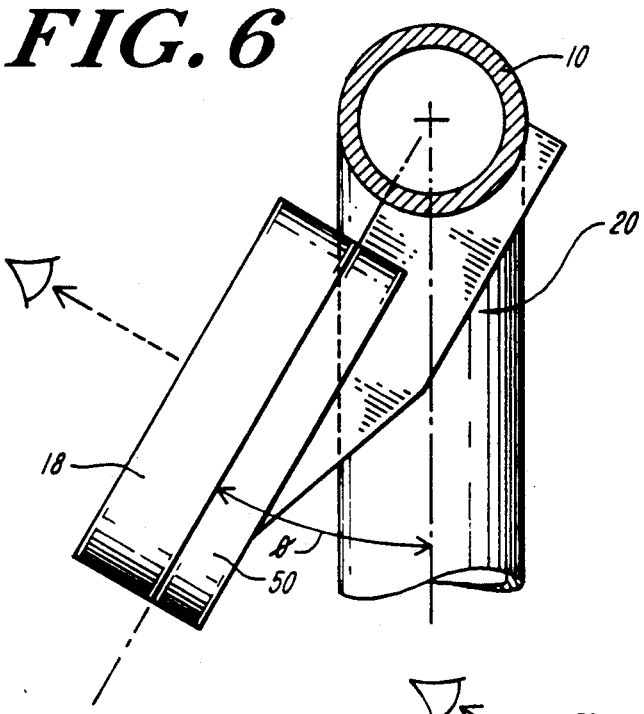
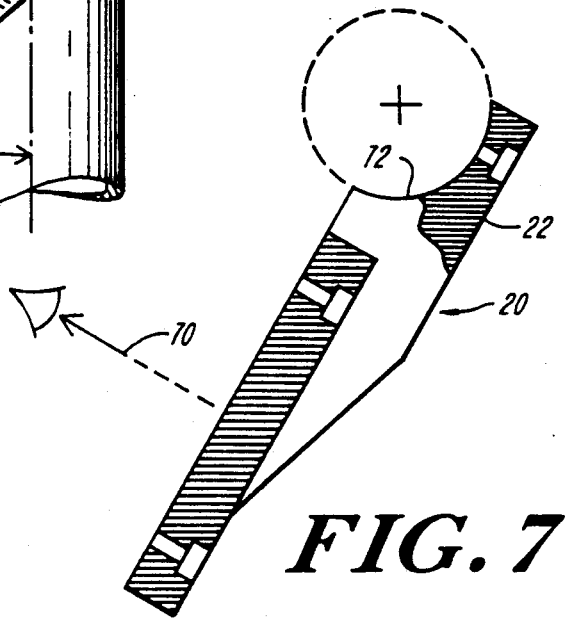
FIG. 7
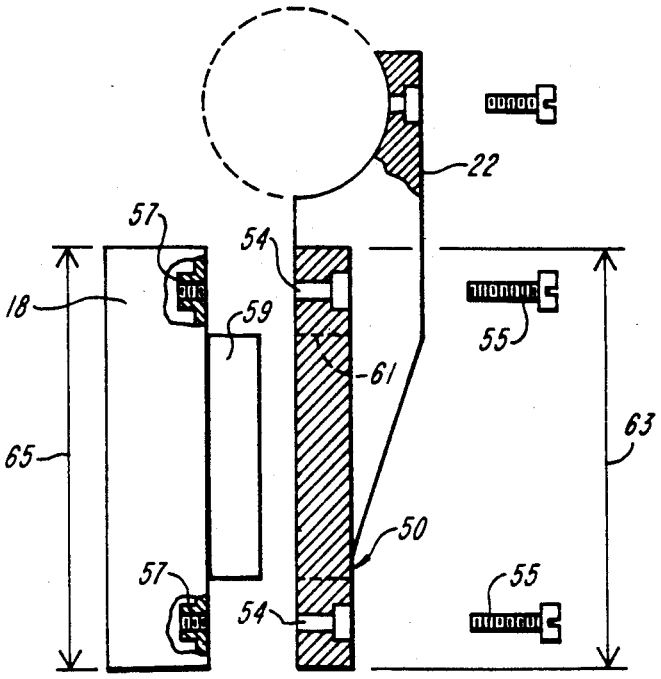
FIG. 8

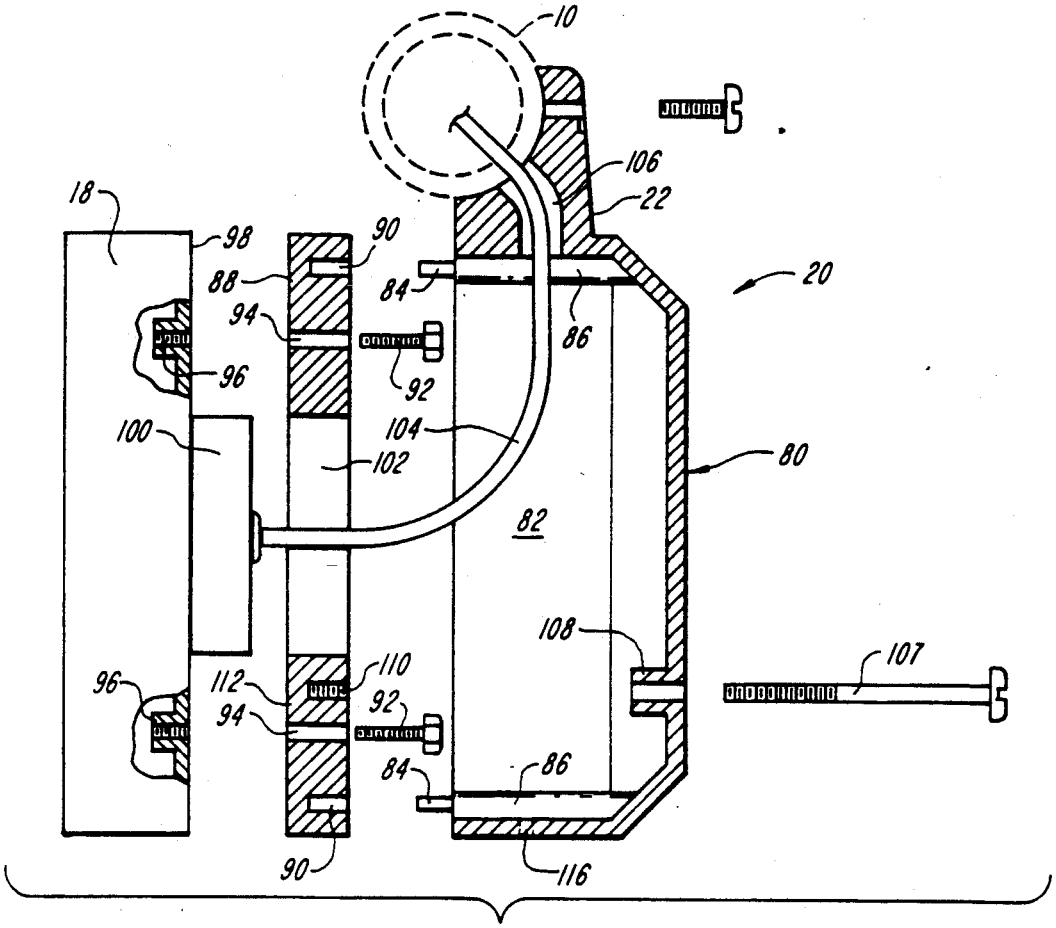
FIG. 9
FIG. 10
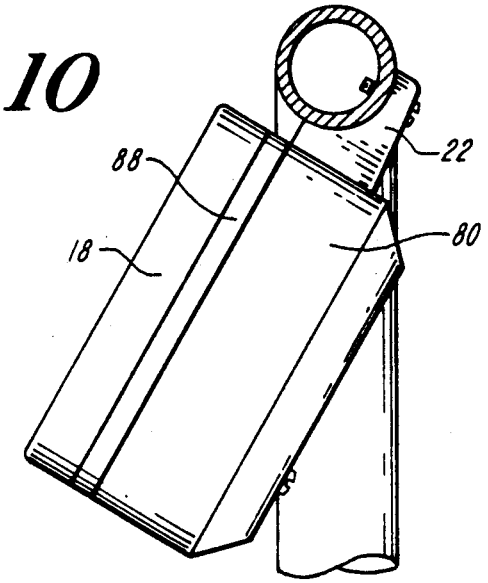

FIG. 11
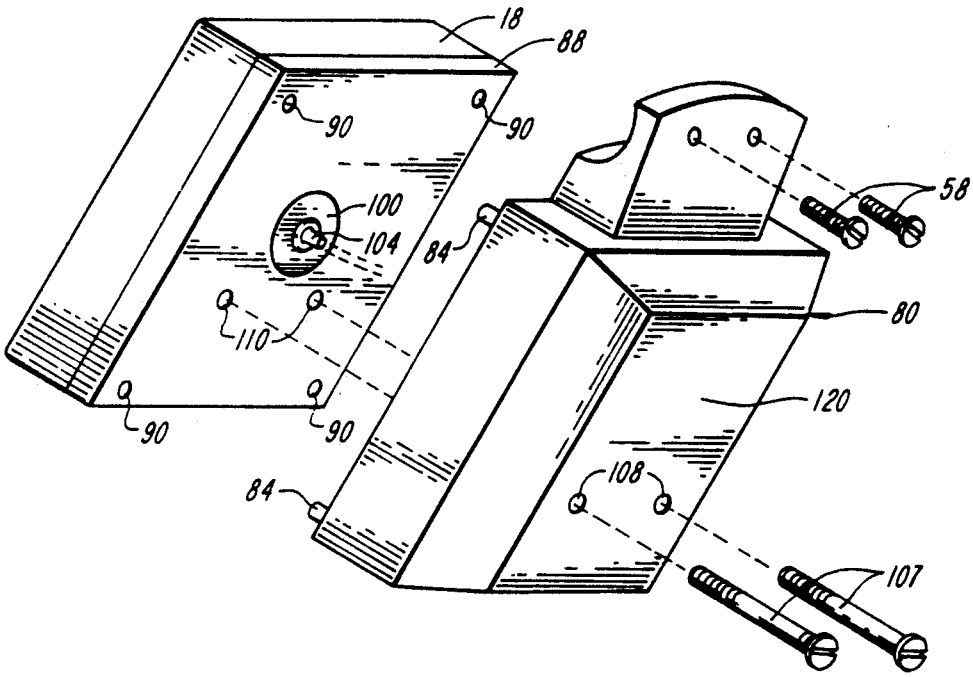
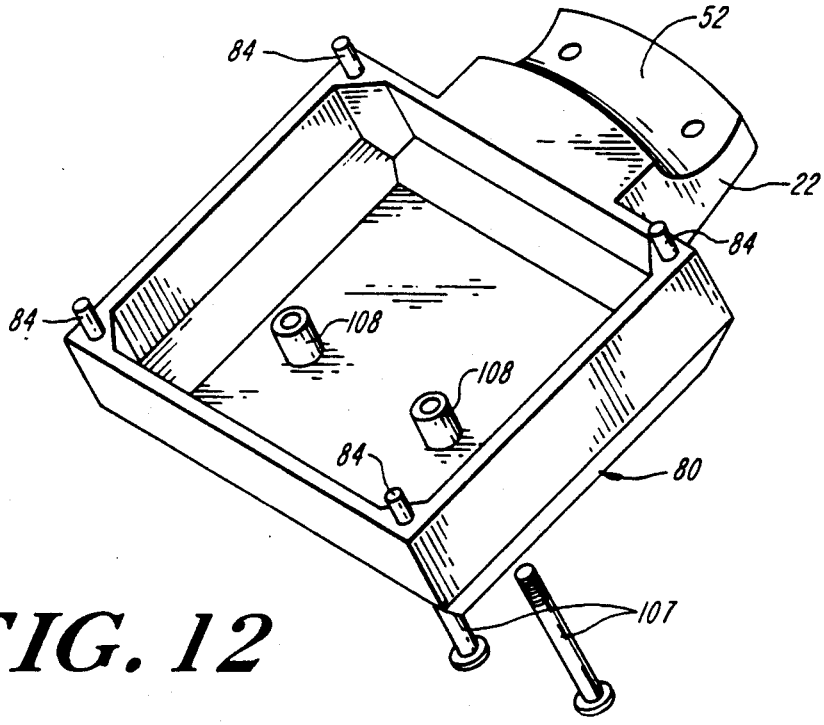
FIG. 12

MOUNTING SYSTEM FOR MARINE INSTRUMENTS

FIELD OF INVENTION

This invention relates to location of marine instruments and more particularly to a hanging pod or pad out to which the instruments are mounted for ease of use and ease of viewing.

BACKGROUND OF THE INVENTION

For many years the helms of sailboats have been provided with a pedestal guard which is an inverted U-shaped structure mounted to the cockpit sole ahead of the wheel and ahead of the binacle for the compass, the purpose of which initially was to provide a grab rail for those in the vicinity of the helm, as well as to protect the compass pedestal from direct contact during sailing. In more recent years, the pedestal guard has been utilized as a support structure for such diverse items as foldable tables, and instrument platforms which are shelves mounted transverse to the longitudinal axis of the pedestal guard onto which are mounted marine instruments such as depth finders, Lorans, GPS, Fluxgate compasses, knot meters, or any other type of data display terminal. In the past, these shelves have been cantilevered from the arms of the pedestal, with pods being mounted vertically on the platform in the form of large bulbous housings for deep instruments. These housings in general have cylindrical bases, with heads which are canted upwardly.

With the microminiaturization of electronics and the provision of remote terminals in compact reduced-size slim line configurations, there is the opportunity to provide a convenient unobtrusive mounting system for such instruments. It will be appreciated that these instruments may be multi-function instruments, the function of which is controlled by buttons or switches directly on the face of the instrument.

Thus, with the type of miniaturization and consolidation of instrument functions, there is opportunity for the location of these devices within easy reach and viewing of the helmsman.

In the past, these instruments were mounted either at the bulkhead next to the companionway or were mounted on a bridge-type structure above the companionway some ten to twelve feet away from the helmsman. These types of mounting diminish the ability of the helmsman to read the instruments because of the distance.

In an effort to co-locate the instruments at the helm, bulbous pods were mounted on a shelf cantilevered from the pedestal guard at about waist height. The shelf thus provides a support for relatively large bulbous pods to either side of the pedestal guard. As will be appreciated, this type of pod mounting does not present the information at eye level, but rather down and to either side of the wheel. Thus, this instrument mounting system caused the helmsman to look down and aside in order to read the instruments.

SUMMARY OF THE INVENTION

With the advent of flat LCD or LED displays within a compact instrument housing of approximately 4½ by 4½ inches, and with an average inside diameter of the arched portion of the pedestal guard on the order of 8 to 8½ inches, in the subject system, these compact instruments are suspended within the arch of the pedestal guard hanger attached to the center of the arch. The result is that the instrument is suspended downwardly from the top of the arch and is canted in such a direction that the screen of the instrument is easily viewable by the helmsman as he looks straight ahead. The result of mounting the instrument in this fashion provides a convenient position for viewing the multifunction instrument along the lubber line immediately above the compass.

The suspension of the instrument is accomplished in one embodiment by providing a tang-like structure above a relatively small pod or pad, with the tang having an open channel configured to conform to the exterior surface of the bottom of the arch. When secured, the tang is pressing firmly against the guard. When the pad or pod is mounted in such a manner, the curvature of the arch in cooperation with the curvature of the tang channel locates the instrument and cantes it upwardly at a predetermined angle. Moreover, in one embodiment the exterior dimensions of the pad or pod are such that the upper edge of the pad or pod is adjacent the inner diameter of the arch to locate the instrument as far as possible away from the compass.

In one embodiment, the size of the pad or pod is made to exactly match the exterior dimension of the instrument to permit maximum clearance above the compass. This flush mounting of the instrument to the pod or pad also permits pads or pods to be configured so that there is no necessity of providing housing flanges which extend beyond the sides of the instrument itself.

As to the pod-type structure, the pod provides clearance to permit rearwardly projecting barrels to protrude into the interior of the pod. The pod itself is desirable because of the water tightness and waterproofing that it can provide, especially for instruments which are not waterproof or water resistant at the rear of the instrument. Moreover, the pod configuration permits waterproofing and a chafe guard for the cables from the instrument which, in one embodiment, may be run through an internal channel of the tang and into the conduit which forms the pedestal guard.

The result of the suspension of the instrument from the center of the arch of the pedestal guard permits presenting navigation data to the helmsman in the direction of his gaze. This mounting system is especially useful with compact multi-function data terminals. The closeness of the data terminal to the helmsman permits changing the function of the instrument by the helmsman pressing the keys or buttons on the instrument, thereby eliminating the necessity of multiple instruments mounted at the helm.

The pod or pad housing is a universal housing, and in one embodiment is an integral structure, which is universal in the sense that it may be suspended from virtually any presently available pedestal guard, such that virtually any pedestal guard may be adapted to sling or hang the instrument within its arch.

Further, because wires may now be led through the pedestal guard instead of directly to the pedestal wire or cable, chafing normally associated with pod-mounted instruments is completely eliminated.

In an alternative embodiment, the instrument can be mounted within the arch with a hose-clamp type structure or any clamping system which permits the instrument to be slung beneath the arch invisible thereat.

In summary, a hanging pad or pod is provided for marine instruments, suspended from the arch of a pedestal guard such that the instrument is inclined with respect to the vertical axis for easy viewing in order to present navigational data close to the helmsman. The proximity of the pad or pod to the helmsman also permits easy data entry from the helm. The pad/pod mounting configuration permits the relatively small microprocessor-based instruments to be mounted within the arch of the pedestal guard, with the mounting system providing that the instrument is tilted towards the user due to the cooperation of the contour of an open channel in the tang of the pad or pod with the surface of the arched portion or contour of the pedestal guard. In one embodiment, namely, the pod embodiment, the pod not only serves to locate the instrument, but also provides a water resistant housing for instruments not having a waterproof back. Drain holes are provided for ventilation and draining at the bottom of the pod housing, whereas, for size minimization, the pod/pad exterior dimension is made equal to that of standard microprocessor-based instrument housings. The mounting system permits the instrument mounting flush with the underside of the arch away from the compass, thus precluding the necessity of providing a taller guard. The tang portion of the hanger is made relatively short to minimize the effect of the lever arm formed by the tang and the housing when the helmsman pushes buttons to enter data into the instrument. Moreover, the cooperation of the open channel of the tang and the arch of the pedestal guard along with the short distance between the top of the housing and the channel provides mechanical stability such that pushing of the buttons on the instruments will not dislodge the housing. In one embodiment, the pod is provided with a channel through the tang so as to be able to hide the wires within the channel and pass the wires through the guard.

BRIEF DESCRIPTION OF THE DRAWINGS

These and other features of the Subject Invention will be better understood in conjunction with the Detailed Description in conjunction with the Drawings, of which:

FIG. 6 is a diagrammatic representation and side view of an instrument and pad mounted to the arch of the pedestal guard showing the inclination of the instrument/pad combination with respect to the vertical axis of the pedestal guard;

FIG. 7 is a diagrammatic representation of the pad mounting system shown in FIG. 6 illustrating the upwardly pointing direction of viewing for an instrument mounted on the pad;

FIG. 8 is a side and cross-sectional view of the pad embodiment of the subject invention, illustrating the position of the tang relative to the pad, and showing the flush mount of the instrument to the pad, also showing mounting screws therefor, as well as an optional aperture in the pad to accommodate the barrel of an instrument;

FIG. 9 is a side and cross-sectional view of the pod embodiment of the subject invention, illustrating the interposition of an intermediary member between the instrument and the face of the pod body, with the instrument being mounted to the intermediate member, and with the intermediate member being positioned with respect to the pod body through the utilization of locator pins, and with the intermediate member being secured to the pod body through screws which project from the rear of the pod up through threaded apertures in the intermediate member, with the length of the screws being such as not to project into the instrument mounted thereon;

FIG. 10 shows a side view of a completed pod configuration illustrating the instrument mounted flush to the intermediate member which is mounted flush to the pod;

FIG. 11 is an exploded view of the pod of FIG. 10 illustrating an instrument premounted to the intermediate member, with the intermediate member being mounted to the pod through the utilization of screws which project from the rear of the pod through the intermediate member;

FIG. 12 is a diagrammatic view of the face of the pod of FIG. 11 illustrating the utilization of locating pins and integral screw guides for utilization of mounting the intermediate member to the pod;

DETAILED DESCRIPTION

Figure 1:
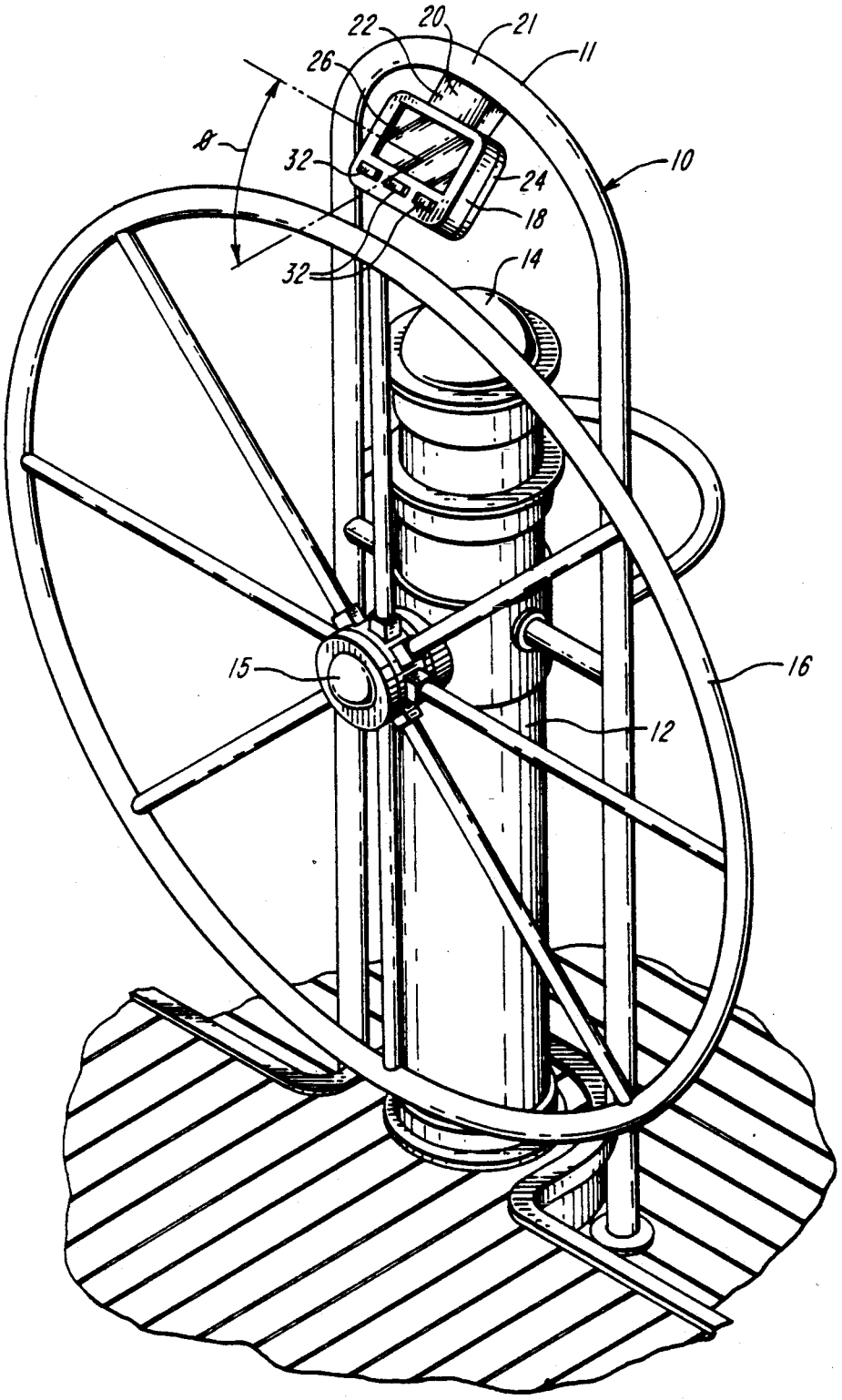
FIG. 1 is a diagrammatic representation of the helm of a vessel illustrating the pedestal guard and an instrument suspended via the subject pad/pod, also showing the spacing of the instrument from the compass mounted at the top of the pedestal.

Referring now to FIG. 1 in the typical configuration, a tubular pedestal guard 10 having a circular arch 11 is positioned about a pedestal 12 atop which is mounted a compass 14. The pedestal includes a shaft 15 to which a wheel 16 is mounted.

An instrument 18 is mounted to the top 21 of the pedestal guard through the utilization of a mounting fixture 20 which includes a tang 22 and a pad or pod 24 onto which instrument 18 is mounted.

The mounting fixture 20 locates instrument 18 such that the face 26 of the instrument points upwardly in the direction of the eyes of the helmsman (not shown).

As can be seen, the instrument is located within the arch of the pedestal guard at a position spaced from the top portion of the compass and in the direction of the lubber line of the vessel. By mounting the instrument in this position, the instrument is readily visible, with the display of the instrument being visible in the line of sight of the helmsman as he peers ahead over the wheel and compass. Moreover, the instrument is protected by the arch of the pedestal guard from inadvertant contact, with keys 32 of the instrument being readily accessible from the helm, such that the helmsman can select displays on the instrument with ease.

Figure 2:
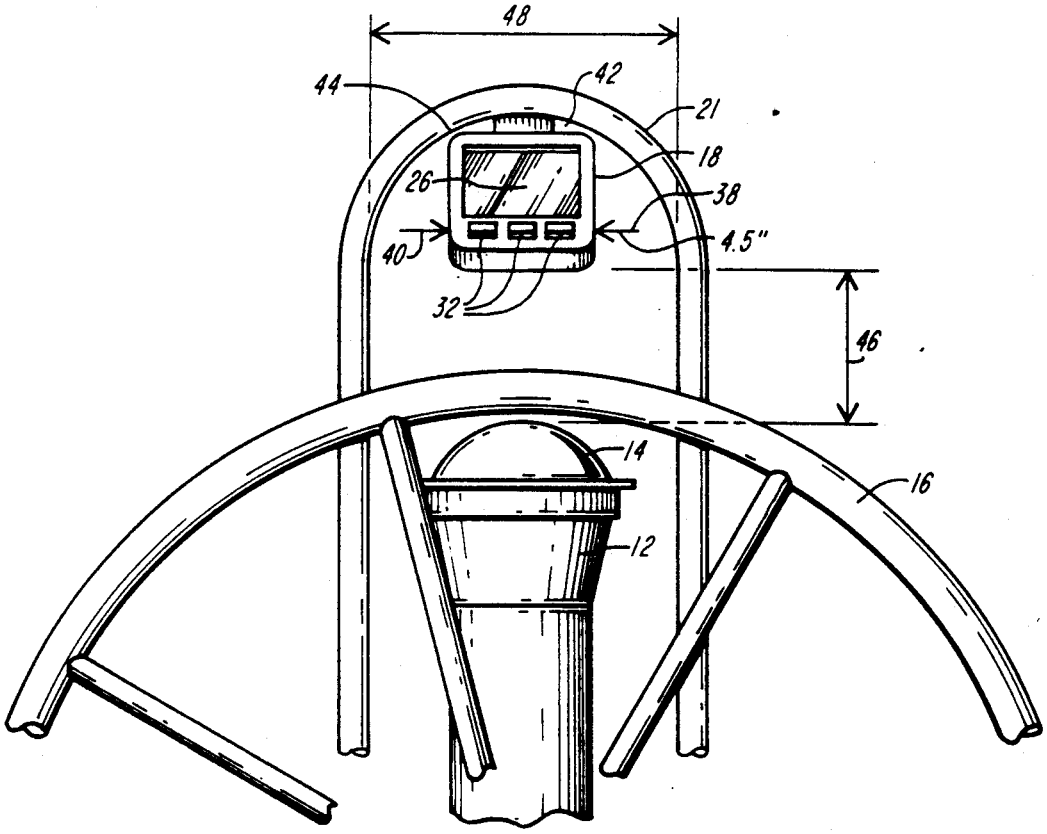
FIG. 2 is a diagrammatic and front view of the installation of FIG. 1 showing the line of sight over the compass and through the suspended instrument, also illustrating the relationship between the topmost part of the instrument and the innermost portion of the arch of the guard.

Referring now to FIG. 2 instrument 18 presents navigational or other data on screen 26. Because of the compact size of instruments having in general an outside dimension of 4.5 inches on a side as illustrated by arrows 38 and 40, it is possible to locate the instrument within arch 21 such that the top edge 42 of instrument 18 is nearly flush with the interior surface 44 of the top portion of the arch. This permits locating the instrument a maximum distance 46 from the top of compass 14.

The above mounting system permits compact instruments to be mounted within the arch of a pedestal guard close to the top of the arch to maximize the distance between the instrument and the compass and to provide that the instrument screen be in the line of sight of the helmsman.

In general, common pedestal guards have an inside diameter 48 of approximately 8.5 inches. 4.5 inches is the normal lateral dimension for common compact marine instruments. Thus the subject mounting fixture permits convenient mounting for compact instruments within the arch.

Figure 3:
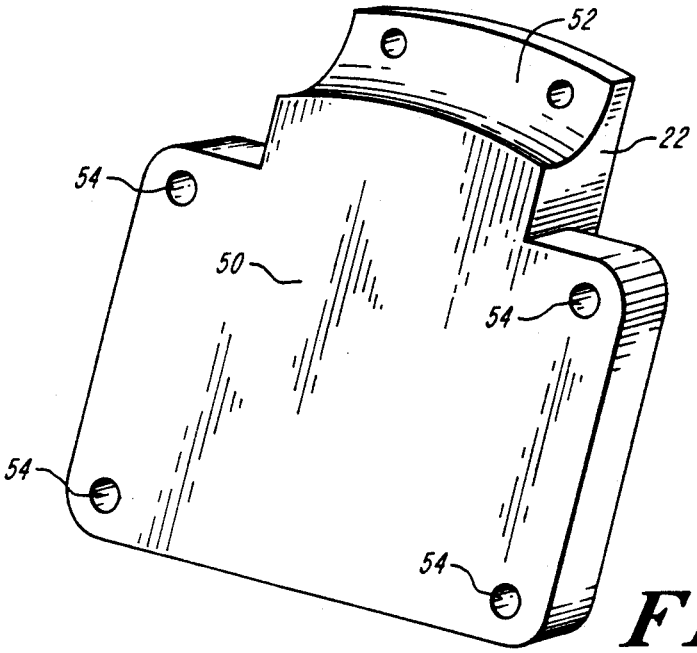
FIG. 3 is a diagrammatic representation of the pad configuration of the subject invention illustrating a channeled tang above the pad structure, with the channel configuration matching that of the associated arched portion of the pedestal guard.

Referring now to FIG. 3, mounting fixture in 21 in one embodiment includes a mounting pad 50 to which an instrument is flush mounted, with the mounting pad having the aforementioned tang 22 integrally or otherwise attached thereto and projecting upwardly as illustrated. Tang 22 has an open channel 52 contoured and configured to be pressed against the top of the arch of the pedestal guard such that not only is the mounting fixture secured to the top of the pedestal guard, but also is such that the face of pad 50 is oriented upwardly, in one embodiment canted 15° to the vertical. Note, the pad may be provided with apertures 54 for mounting screws for mounting the instrument thereupon.

Figure 4:
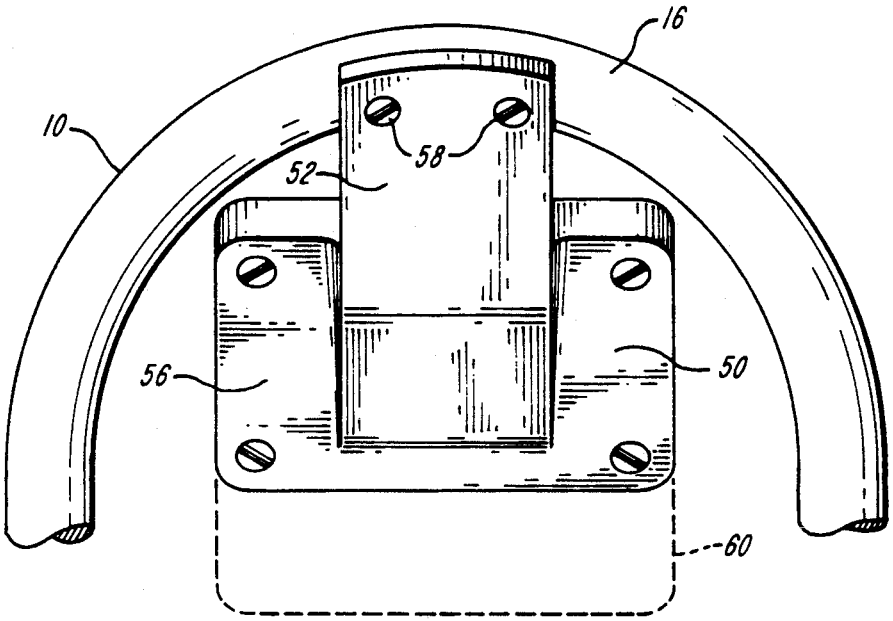
FIG. 4 is a diagrammatic and back view of the pad of FIG. 3, illustrating the integral attachment of the tang to the pad along with the position of four corner mounting screws for attaching the instrument to the pad.

Referring to FIG. 4, pad 50 is shown with a integral tang 52 projecting from the back surface 56 of the pad and joined to pedestal guard 10 via rivets, screws or bolts 58 which project through the tang and into the pedestal guard. Dotted outline 60 shows that the vertical extent of the pad may be extended to accommodate larger instruments, whereas the lateral extent of the pad is determined by the diameter of the arch and the length of the tang. It will be appreciated that tang length is kept to a minimum so as to minimize the lever arm for increasing mechanical stability.

Figure 5:
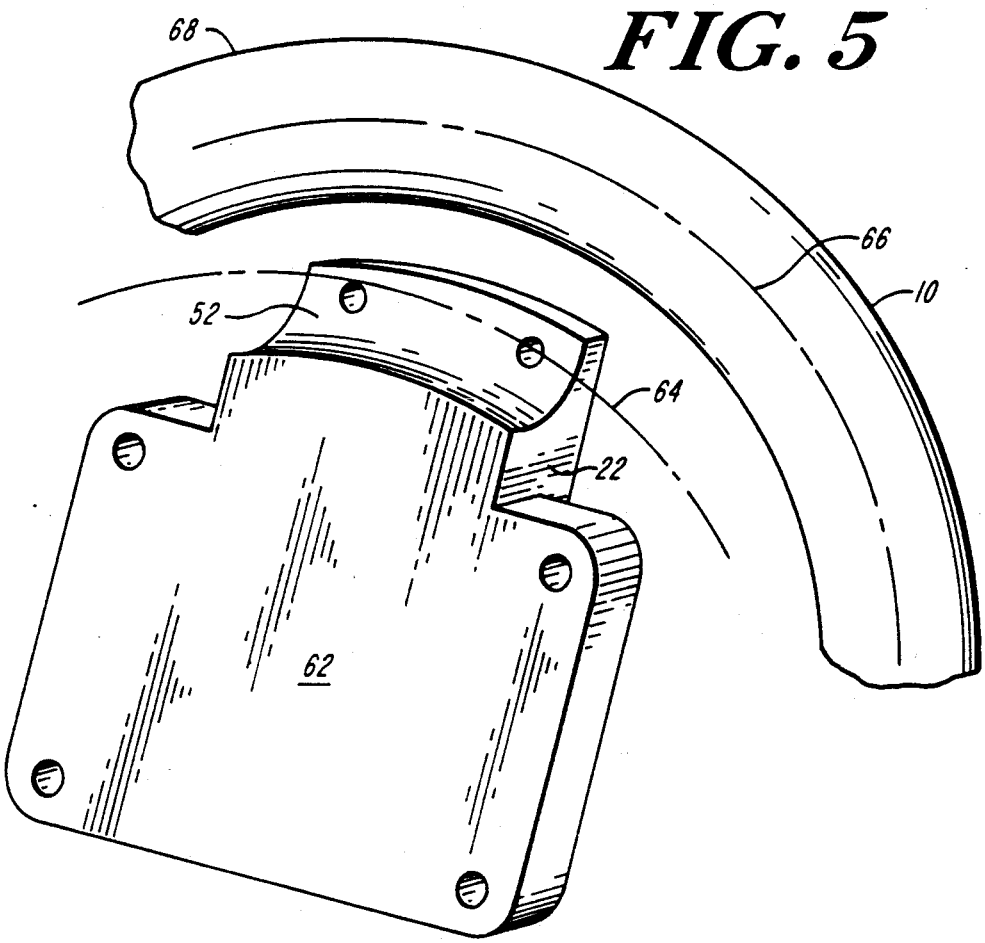
FIG. 5 is a diagrammatical illustration of the tang of FIGS. 3 and 4, showing the relationship of its curved centerline to that of the arch of the pedestal guard.

Referring now to FIG. 5, tang 22 is illustrated as being attached to a pad or pod here illustrated at 62 with the channel 52 having an axis 64 which is co-linear with an axis 66 of pedestal guard 10. With the surface of the open channel 52 conforming to the outer surface 68 of pedestal guard 10, it will be appreciated that, as illustrated in FIG. 6 mounting fixture 20 can be canted at an angle illustrated by $\phi$ such that pad 50 is oriented at this angle, with the instrument 18 mounted to the face of the pad. Thus, as illustrated in FIG. 7, the line of sight illustrated by dotted arrow 70 can be set to any preset angle by virtue of the curvature of surface 72 of tang 22.

Referring to FIG. 8, pad 50 is illustrated as having the aforementioned apertures 54 to accommodate bolts 55 therethrough for insertion into integral nuts 57 within the instrument 18 housing. Likewise, if the instrument has a rearwardly projecting barrel 59, this may be accommodated through an aperture 61 within pad 50. The routing of the wires from the instrument may be along the pad and directly into the pedestal guard immediately adjacent the tang to prevent undue chafing, with the tang providing a certain amount of protection for the cable.

Referring now to FIG. 9 mounting fixture 20 may include a hanging pod structure which includes a pod housing 80 to which tang 22 is fixedly attached. The pod housing 80 has an interior cavity 82 opened outwardly, with locator pins 84 mounted to struts 86 in at least 2 corners of the housing.

An intermediate member 88 serves to mount instrument 18 to pod housing 80, with intermediate member 88 having blind holes or slots 90 therein corresponding in position to locator pins 84.

In operation, instrument 18 is mounted to intermediate member 88 via bolts 92 which project through apertures 94 into integral threaded nuts 96 within the back plate 98 of instrument 18.

The instrument optionally may have a barrel 100 projecting rearwardly as shown, and intermediate member 88 is provided with a corresponding aperture 102 as illustrated to accommodate the barrel. An interconnect cable 104 is shown extending rearwardly from barrel 100 and is routed through a channel 106 within tang 22 to the interior of the tubular channel making up pedestal guard 10.

Once the instrument is mounted to the intermediate member, the combination is mounted to pod housing 80 via threaded screws 107 which project through integral screw guides 108, with the screw extending into threaded apertures 110 in intermediate member 88. The length of the screws 107 is such that, with the intermediate member 88 in place, they do not extend past the top surface 112 of the intermediate member.

It will be appreciated that the pod mounting system illustrated in FIG. 9 can be made water resistant or waterproof with the sealing of the instrument to the intermediate member and the sealing of the intermediate member to the pod housing. As such the connection cable 104 is prevented from chafing due to its enclosure within the housing and through channel 106 in tang 22 the pedestal guard. Optionally, it will be appreciated that drip holes 116 may be provided in the base of the pod housing, should any moisture accumulate within the pod housing itself.

It will also be noted that the lateral extent 63 of the pad is commensurate with the lateral extent 65 of the instrument to provide a flush mounting system, thereby precluding the necessity of providing an oversized pad structure.

Referring now to FIG. 10 and the pod configuration of FIG. 9, instrument 18 is shown flush to intermediate member 88 and pod housing 80, with tang 22 locating the pod and its instrument so that it can be viewed from the helm.

Referring to FIG. 11, instrument 18 is shown mounted on intermediate member 88, in which notches 90 are clearly shown. In the embodiment shown, the pod housing 80 has a truncated pyramid shaped back portion 120 through which apertures 108 extend, with corresponding apertures 110 in intermediate member 88 being located as illustrated.

Referring now to FIG. 12, pod housing 80 is shown opened upwardly to illustrate tang 22 with its open channel 52, also illustrating locator pins 84, screws 107 and inwardly projecting integral screw guides 108.

Figure 13:
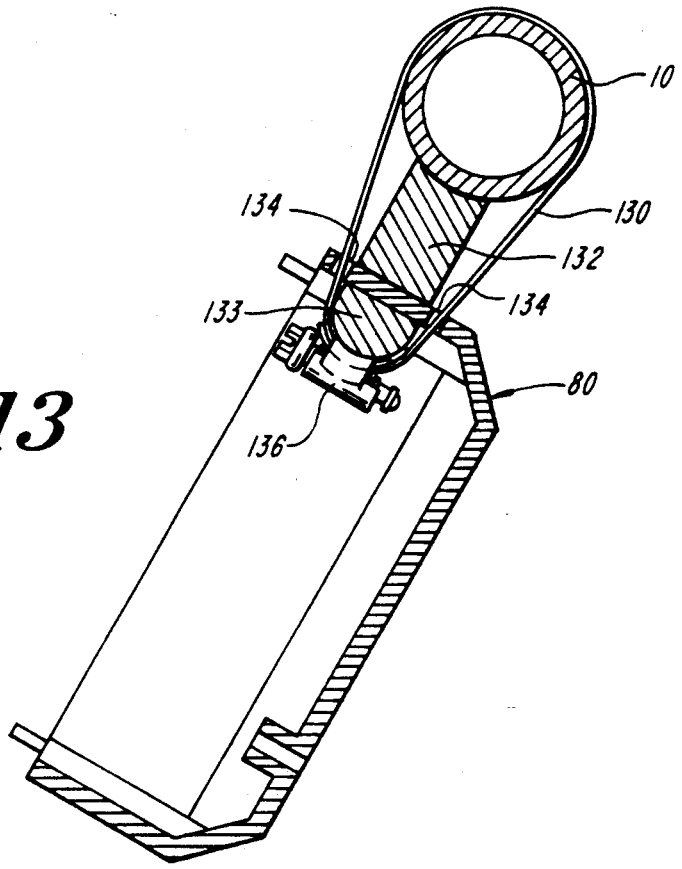
FIG. 13 is a side view of an alternative mounting and clamping system for suspending the instrument pad/pod beneath the arch of the pedestal guard, indicating a hose clamp-type configuration; and, FIG. 14 is a front view of the mounting system of FIG. 13, illustrating the utilization of an insert between the top of the pad/pod housing and the interior of the pedestal guard arch, also illustrating screw tightening apparatus within the pod for clamping the assembly to the guard.

Referring now to FIG. 13, in an alternative embodiment, pod housing 80 may be strapped to the upper portion of the arch of pedestal guard 10 by a strap 130 which is wrapped around pedestal guard 10 and over a spacer 132 through apertures 134 in the top of housing 80 and thence to a tensioning screw or device 136 within the pod housing.

Figure 14:
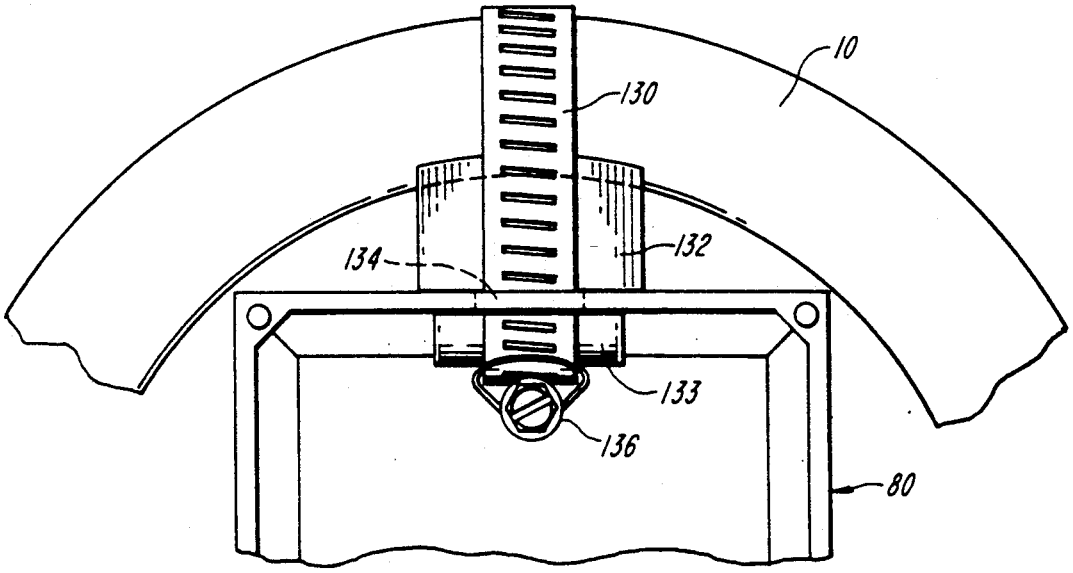

As illustrated in FIG. 14, strap 130 passes around spacer 132 which is configured with the appropriate channel to match the corresponding surface of the top portion of the pedestal guard.

Within the pod body is shown a second spacer 133 and hose clamp type tensioning apparatus including a tightening screw 136, with the apparatus within pod housing 80 being such that the clamping strap is provided with tooth-engaging slits 138.

Whether the pod is slung from the top of the arch of the pedestal guard via the tang arrangement of FIGS. 1–12 or the strap clamping arrangement of FIGS. 13 and 14, the net result is that a compact instrument may be hung or slung within the arch for both protection and line of sight viewing, while at the same time being angled upwardly so as to provide the helmsman with a convenient visual reference. As a result, for multi-function instruments, the helmsman may select the display required within easy reach of the helm. Rather than having to look some ten to twelve feet away at a bulkhead on which instruments are mounted, or rather than having to look to the side and down as with conventional pods, all of the navigational data required is not only at his fingertips but within his line of sight.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. Apparatus for locating a marine instrument for easy viewing and access by the helmsman of a vessel having an inverted U-shaped pedestal guard at the helm comprising:

means for suspending said instrument within the arch formed by the upper part of said U-shaped pedestal guard such that the face of said instrument is within the view of the helmsman, whereby said instrument is at least partially protected by said guard, is viewable from the helm along the lubber line of said vessel, and is within easy reach of said helmsman for the actuation thereof, said suspending means including an instrument mounting fixture and means attached to the top center of said arch for suspending said fixture immediately therebeneath.

2. The apparatus of claim 1 wherein said suspending means includes a tang fixedly attached at one end to said fixture and at its other end to said pedestal guard.

3. The apparatus of claim 2 wherein said tang includes an open channel at said other end thereof, said channel being configured to mate with the corresponding portion of the exterior surface of said pedestal guard.

4. The apparatus of claim 3 wherein said channel and said arch have axes which are parallel one to the other.

5. The apparatus of claim 2 wherein said tang includes means for the attachment thereof to said pedestal guard such that said fixture holds said instrument in an upwardly facing orientation at a predetermined angle to the local vertical.

6. The apparatus of claim 5 wherein said angle is 15°.

7. The apparatus of claim 1 wherein said instrument mounting fixture includes a pad and a tang extending therefrom, at the top thereof, means for securing the distal end of said tang to said arch and means for mounting said instrument on said pad.

8. The apparatus of claim 7 wherein said instrument and said pad have matching outer dimensions such that said instrument is mounted flush with said pad.

9. The apparatus of claim 7 wherein said instrument has threaded mounting apertures therein and wherein said pad has apertures therethrough and further including mounting screws through said pad at positions corresponding to said threaded mounting apertures.

10. The apparatus of claim 1 wherein said instrument mounting fixture includes a pod and a tang extending therefrom at the top thereof, said pod including a housing having a predetermined depth and a cavity opened at the front therefor, means for mounting said instrument to the front of said housing, and means for securing the distal end of said tang to said arch.

11. The apparatus of claim 10 wherein said instrument includes a cable extending from the rear thereof into said cavity, said tang having a channel therethrough from the interior of said cavity to the distal end of said tang for accommodating said cable therein such that said cable may be run through said pod housing and said tang to the interior of said pedestal guard.

12. The apparatus of claim 11 and further including means for sealing said instrument to said pod housing for water resistance.

13. The apparatus of claim 11 wherein said instrument mounting fixture includes an intermediate member sandwiched between said instrument and the front of said pod housing, whereby said instrument may be first mounted to said intermediate member prior to mounting said intermediate member to said pod housing.

14. The apparatus of claim 13 wherein said intermediate member includes locating holes and wherein the face of said pod housing includes outwardly projecting locating pins corresponding in location to said holes.

15. The apparatus of claim 1 wherein said suspending means includes an instrument mounting fixture and means for clamping said fixture to said arch.

16. The apparatus of claim 15 wherein said clamping means includes a strap, means for locating a portion of said strap around said pedestal guard and means for tensioning said strap.

17. The apparatus of claim 15 wherein said clamping means include an insert between said fixture and the underside of said arch, said insert having an open channel therein positioned to coact with the underside of said arch and having a configuration mating with the undersurface of said arch and matching the under surface of said arch.

* * * * *